United States Patent [19]

Tamura et al.

[11] Patent Number: 4,818,198

[45] Date of Patent: Apr. 4, 1989

[54] SCROLL FLUID MACHINE WITH OIL FEED PASSAGES

[75] Inventors: Takahiro Tamura, Shimizu; Kazuo Sakurai, Shizuoka, both of Japan

[73] Assignee: Hitachi, Ltd., Tokyo, Japan

[21] Appl. No.: 120,098

[22] Filed: Nov. 13, 1987

[30] Foreign Application Priority Data

Nov. 26, 1986 [JP] Japan ..... 61-281092

[51] Int. Cl.[4] ..... F04C 18/04; F04C 29/02

[52] U.S. Cl. ..... 418/55; 418/57; 418/91; 418/94; 418/96

[58] Field of Search ..... 418/55, 88, 91, 94, 418/96, 98, 99, 57; 417/902; 184/6, 16

[56] References Cited

U.S. PATENT DOCUMENTS 3,986,799 10/1976 McCullough ..... 418/91
4,538,975 9/1985 Tsukagoshi ..... 418/55
4,551,082 11/1985 Hazaki et al. ..... 418/55

FOREIGN PATENT DOCUMENTS 58-15787 1/1983 Japan ..... 418/94
59-29791 2/1984 Japan ..... 418/98
59-93982 5/1984 Japan ..... 418/55
59-185892 10/1984 Japan ..... 418/99

*Primary Examiner*—John J. Vrablik
*Attorney, Agent, or Firm*—Antonelli, Terry & Wands

[57] ABSTRACT

A scroll fluid machine comprising a pair of fixed and orbiting scrolls having their respective wraps in mesh with each other. A drive shaft engaging the orbiting scroll is connected to an electric motor and is supported by a frame. An end plate of the oribiting scroll is slidably held between the frame and an end plate of the fixed scroll. A first feed oil passage is formed in at least one of the end plate of the fixed scroll and the frame. The first passage has one end communicates with an oil reservoir defined at a bottom of the housing and the other end opening on a sliding surface contacting with the orbiting scroll. A second feed oil passage formed in the end plate of the orbiting scroll has one end always communicating with the other end of the first passage. The other end of the second passage is located in the vicinity of the axis of the orbiting scroll. A third feed oil passage formed in the drive shaft has one end communicating with the other end of the second passage.

4 Claims, 3 Drawing Sheets

SCROLL FLUID MACHINE WITH OIL FEED PASSAGES

BACKGROUND OF THE INVENTION

This invention relates to a scroll fluid machine serving as a gas compressor for raising pressure of refrigerant gas or the like, a gas expander or a liquid pump and, more particularly, to a structure for feeding oil to each bearing and each sliding surface of the scroll fluid machine.

A hermetic scroll compressor, which is an example of a scroll fluid machine, is known from U.S. Pat. No. 4,551,082. The scroll compressor comprises a closed housing and a compressor component arranged in an upper portion of the closed housing. A feed oil structure of the scroll compressor includes an oil reservoir defined at a bottom of the housing. A crankshaft has its lower end which is submerged in the oil within the oil reservoir. The crankshaft is formed therein with a feed oil passage communicating a lower end face of the crankshaft with various bearing sections. Centrifugal force or pressure difference is utilized to feed the oil within the oil reservoir to the bearing sections through the feed oil passage.

The feed oil structure disclosed in the abovementioned U.S. Pat. No. 4,551,082 is applicable to an arrangement in which a compressor component is disposed in an upper portion of a closed housing, but is not applicable to an arrangement in which the compressor component is disposed in a lower portion of the housing or an arrangement in which a crankshaft for driving the compressor component is arranged to have an axis extending horizontally.

Another feed oil structure is known from U.S. Pat. No. 4,538,975, in which oil contained in suction refrigerant gas is separated from the latter and the separated oil is fed to various bearing sections. It is difficult for such feed oil structure, however, to secure a sufficient amount of oil.

SUMMARY OF THE INVENTION

It is an object of the invention to provide a scroll fluid machine in which oil is fed to each bearing and each sliding surface stably by a simple structure.

According to the invention, there is provided a scroll fluid machine comprising a closed housing, a pair of fixed and orbiting scrolls arranged within the closed housing and each having an end plate and a spiral wrap integral with the end plate, the pair of fixed and orbiting scrolls being arranged such that their respective spiral wraps are in mesh with each other, the orbiting scroll being arranged to move in orbital motion relative to the fixed scroll without rotation on an axis of the orbiting scroll, a drive shaft for driving the orbiting scroll in orbital motion relative to the fixed scroll, and a frame arranged within the closed housing for supporting the drive shaft, the end plate of the orbiting scroll being slidably held between the end plate of the fixed scroll and the frame, characterized in that a first feed oil passage is formed in at least one of the end plate of the fixed scroll and the frame, the first feed oil passage having one end communicating with an oil reservoir defined at a bottom of the closed housing, the other end of the first feed oil passage opening on a sliding surface contacting with the orbiting scroll, that a second feed oil passage is formed in the end plate of the orbiting scroll, the second feed oil passage having one end always communicating with the other end of the first feed oil passage, the other end of the second feed oil passage being located in the vicinity of a center of the orbiting scroll, and that a third feed oil passage is formed in the drive shaft, the third feed oil passage having one end communicating with the other end of the second feed oil passage.

Oil accumulated in the oil reservoir within the closed housing flows through the first feed oil passage and reaches the sliding surface contacting with the orbiting scroll. The oil from the first feed oil passage flows through the second feed oil passage to lubricate neighboring at least one bearing. The oil from the second feed oil passage flows through the third feed oil passage to lubricate neighboring at least one bearing.

The other end of the first feed oil passage, which opens to the sliding surface, is formed to have an opening area sufficient to always communicate with the one end of the second feed oil passage during orbital motion of the orbiting scroll relative to the fixed scroll. In this manner, the sliding surface and the bearing sections for the drive shaft are capable of communicating with the oil reservoir through the first, second and third feed oil passages. Thus, the oil can stably be fed to the sliding surface and the bearing sections.

DETAILED DESCRIPTION

Various embodiments of the invention will be described with reference to the accompanying drawings.

Figure 1:
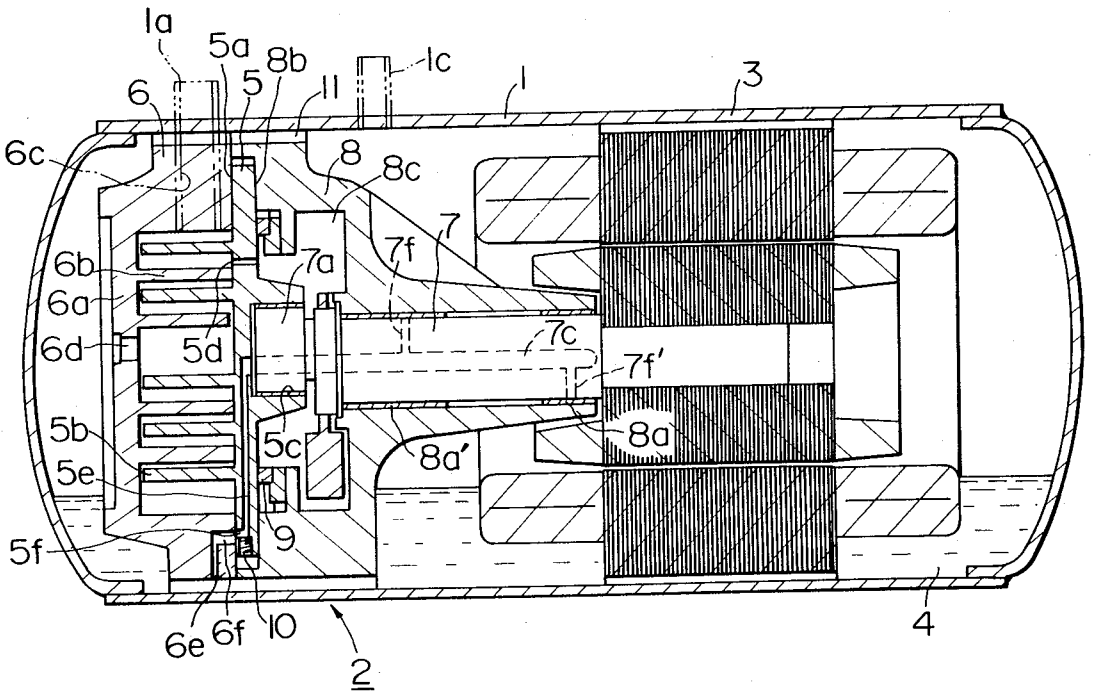
FIG. 1 is a longitudinal cross-sectional view showing an entire arrangement of a hermetic scroll compressor of horizontal type according to an embodiment of the invention.
Figure 2:
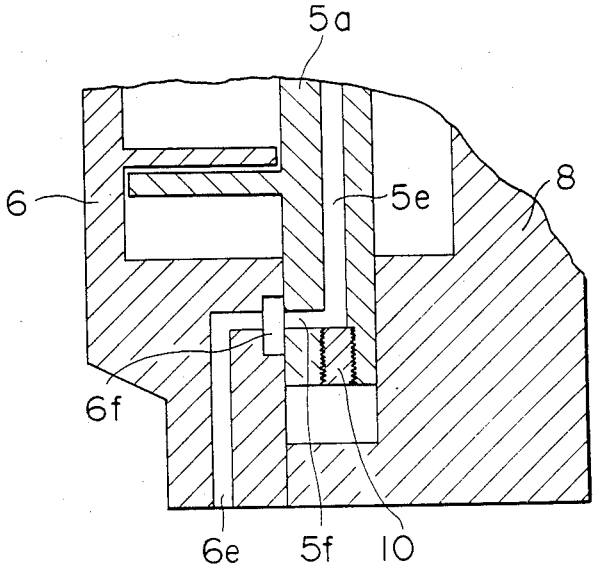
FIG. 2 is an enlarged fragmental view showing first and second feed oil passages in the scroll compressor illustrated in FIG. 1.

Referring first to FIGS. 1 and 2, there is illustrated a refrigerant scroll compressor of horizontal type according to an embodiment of the invention. FIG. 1 is a longitudinal cross-sectional view showing an entire arrangement of the scroll compressor. The scroll compressor comprises a closed housing 1 within which a scroll compressor component 2 and an electric motor 3 are arranged horizontally. An oil reservoir 4 is defined at a bottom of the closed housing 1.

The scroll compressor component 2 comprises an orbiting scroll 5, a fixed scroll 6, a drive shaft 7 serving as a crankshaft driven by the electric motor 3, a frame 8, and a mechanism 9 for preventing the orbiting scroll 5 from rotating on its own axis.

The orbiting scroll 5 has an end plate **5*a* and a spiral wrap 5*b* on the end plate 5*a*. The end plate 5*a* is formed in its rear face with a bore in which a bearing 5*c* is arranged to rotatably support a crank pin 7*a* of the drive shaft 7. The end plate 5*a* is provided therein with a pressure balancing port 5*d* which communicates a pocket under compression defined by the wrap 5*b*, with a back pressure chamber 8*c***.

Likewise, the fixed scroll 6 fixedly secured to the closed housing 1 has an end plate **6*a* and a spiral wrap 6*b* on the end plate 6*a*. A suction port 6*c* is formed in an outer peripheral portion of the wrap 6*b*, and a discharge port 6*d* is formed in the end plate at a center of the wrap 6*b*. A suction pipe 1*a* is connected to the suction port 6*c***.

Bearings 8*a* and 8*a'* are arranged in the frame 8 fixedly mounted to the closed housing 1, to rotatably support the drive shaft 7. The frame 8 has a seat 8*b* which cooperates with the fixed scroll 6 to hold the orbiting scroll 5 therebetween. The back pressure chamber 8*c* is provided for applying an appropriate counter force to the orbiting scroll 5.

The orbiting scroll 5 and the fixed scroll 6 are assembled with each other with their respective wraps 5*b* and 6*b* in mesh with each other. The orbiting scroll 5 is held between the fixed scroll 6 and the seat 8*b* of the frame 8. The mechanism 9 is arranged between the rear face of the orbiting scroll 5 and the frame 8 for preventing the orbiting scroll 5 from rotating on its own axis.

The drive shaft 7 has one end which is formed into the crank pin 7*a* supported by the bearing 5*c*. The drive shaft 7 is formed therein with a feed oil bore 7*c* extending along an axis of rotation of the drive shaft 7. The feed oil bore 7*c* has one end which opens at an end face of the crank pin 7*a*. The feed oil bore 7*c* communicates with the bearings 8*a* and 8*a'* through respective feed oil bores 7*f* and 7*f'*.

The end plate 6*a* of the fixed scroll 6 is formed with a first feed oil bore 6*e* communicating with the oil reservoir 4, and a second feed oil bore 6*f* communicating with the first feed oil bore 6*e*. The second feed oil bore 6*f* opens at a sliding section between the end plate 5*a* of the orbiting scroll 5 and the end plate 6*a* of the fixed scroll 6. The end plate 5*a* of the orbiting scroll 5 has formed therein a fourth feed oil bore 5*e* connecting the end face of the bearing 5*c* with the outer periphery of the end plate 5*a*. The fourth feed oil bore 5*e* has a radially outward end closed by a screw 10. A radially inward end of the fourth feed oil bore 5*e* confronts the end of the feed oil bore 7*c* in the drive shaft 7. A third feed oil bore 5*f* is formed in the end face of the end plate 5*a* which is in sliding contact with the end plate 6*a* of the fixed scroll 6, to connect the fourth feed oil bore 5*e* with the second feed oil bore 6*f* in the fixed scroll 6.

The positional relationship among the above-mentioned feed oil bores is clearly illustrated in FIG. 2 on an enlarged scale. Orbiting motion of the orbiting scroll 5 causes the center of the third feed oil bore 5*f* to move in orbital motion with a crank radius of the crank pin 7*a*, that is, with the same radius as the orbiting radius of the orbiting scroll 5. For this reason, the second feed oil bore 6*f* is formed into a dish shape having a radius of size or dimension equal to or larger than the orbiting radius of the third feed oil bore 5*f*. Thus, the feed oil bores 5*f* and 6*f* always communicate with each other during orbiting movement of the orbiting scroll 5.

The operation of the scroll compressor illustrated in FIGS. 1 and 2 will next be described. As the drive shaft 7 is rotated by the electric motor 3, rotation of the crank pin 7*a* moves the orbiting scroll 5 in orbital motion without rotation on its own axis under the action of the mechanism 9. As a result, pockets defined by the end plates 5*a* and 6*a* and the wraps 5*b* and 6*b* of the respective orbiting and fixed scrolls 5 and 6 are gradually reduced in volume while moving toward the center of the fixed scroll 6. The gas drawn through the gas suction pipe 1*a* and the suction port 6*c* is compressed and discharged through the discharge port 6*d*. The gas discharged flows through a passage 11 formed in the end plate 6*a* of the fixed scroll 6 and the frame 8, to cool the electric motor 3. Subsequently, the gas is discharged through a discharge pipe 1*c*. Compressing action of the orbiting scroll 5 causes forces to act on the scrolls 5 and 6, tending to move them away from each other. In order to prevent the scrolls 5 and 6 from moving away from each other, the pressure within the back pressure chamber 8*c* on the rear side of the orbiting scroll 5 is maintained by the pressure balancing port 5*d* at an intermediate pressure which is lower than the discharge pressure, but is higher than the suction pressure.

The above-noted intermediate pressure acts on the end face of the bearing 5*c* in the orbiting scroll 5 on the side of the back pressure chamber 8*c*, and on the end face of the bearing 8*a* in the frame 8 on the side of the back pressure chamber 8*c*. Thus, differential pressure between the discharge pressure and the intermediate pressure causes the oil within the oil reservoir 4 to be led to the end of the feed oil bore 7*c* in the drive shaft 7 through the first and second feed oil bores 6*e* and 6*f* formed in the fixed scroll 6 and through the third and fourth feed oil bores 5*f* and 5*e* formed in the orbiting scroll 5, so that the feed oil bore 7*c* is filled with the oil. The oil in the feed oil bore 7*c* is fed under centrifugal force to the bearings 8*a* and 8*a'* through the respective feed oil bores 7*f* and 7*f'*. The bearing 5*c* is supplied with the oil fed to the end face thereof through the fourth feed oil bore 5*e*.

Figure 3:
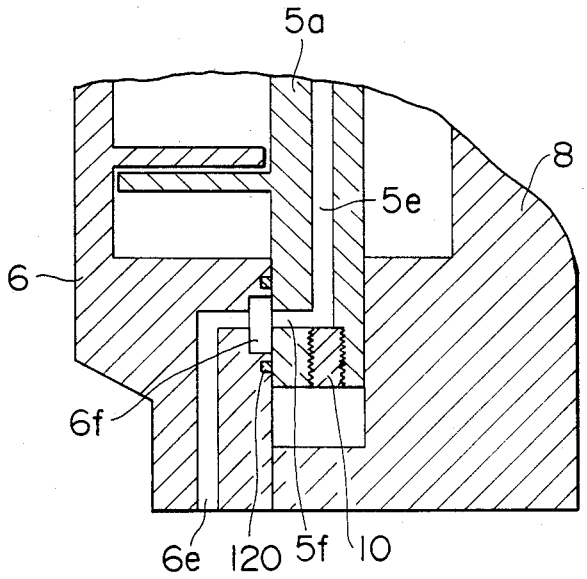
FIG. 3 is a view similar to FIG. 2, but showing another embodiment of the invention.

FIG. 3 shows another embodiment of the invention, in which a seal member 120 is employed to enhance sealing between the third feed oil bore 5*f* and the second feed oil bore 6*f*.

In the above-described embodiments, the differential pressure between the oil reservoir 4 and the back pressure chamber 8*c* is utilized to feed the oil. However, an oil pump may be employed, which is mounted to the axial end of the drive shaft 7.

The embodiments have been described, which are applied to a so-called horizontal type scroll compressor in which the scroll compressor component and the drive shaft for driving the same are arranged horizontally. However, the invention is also applicable to a scroll fluid machine of vertical type in which an electric motor component is arranged in an upper portion of a closed housing, and a compressor component including a pair of scrolls is arranged in a lower portion of the closed housing.

What is claimed is:

1. A scroll fluid machine of horizontal type, comprising a closed housing including a suction port and a discharge port, an oil reservoir at its bottom, an electric motor arranged within said closed housing, a horizontally extending drive shaft driven by said motor, a frame secured to inside of said closed housing for rotatably supporting said drive shaft, and a scroll component arranged within said closed housing and driven by said drive shaft, said scroll component including a fixed scroll and an orbiting scroll each having an end plate and a spiral wrap integrally upstanding from the end plate, the wraps of the respective fixed and orbiting scrolls meshing with each other, said drive shaft being in engagement with said orbiting scroll, said end plate of said orbiting scroll being slidably held between said frame and said end plate of said fixed scroll, said orbiting scroll being arranged to move in orbital motion relative to said fixed scroll without rotation orbiting scroll about its own axis, and said end plate of said fixed scroll being formed with a radial hole for communicating said suction port with a peripheral portion of said scroll wraps, and with an axial hole at the center of the end plate for communicating the central portion of the scroll wraps with said discharge port through a void space of said closed housing for maintaining the pressure inside of said closed housing at a discharge pressure level, wherein said frame is formed with a recess opposite to said end plate of said orbiting scroll for defining a back pressure chamber on the rear side of the orbiting scroll, said end plate of the orbiting scroll is formed with a penetrating hole at a radially intermediate position of the scroll for maintaining the pressure in said back pressure chamber at an intermediate pressure level between the suction pressure level and the discharge pressure level of the scroll machine and pressing said orbiting scroll on said fixed scroll, said end plate of the fixed scroll is further formed with a first feed oil passage having one end communicating with said oil reservoir and the other end opening on a sliding surface contacting with said orbiting scroll, said end plate of the orbiting scroll is formed with a second feed oil passage having one end always communicating with said other end of said first feed oil passage and the other end opening at the vicinity of the orbiting axis of the orbiting scroll opposite to said drive shaft, and said drive shaft is formed with a third feed oil passage having one end communicating with said other end of said second feed oil passage and the other end of said second feed oil passage and the other ends opening to the bearing portions of said frame supporting said drive shaft, said bearing portions communicating with said back pressure chamber, such that the oil is forced to flow from said oil reservoir to said contact surfaces of said scrolls and to the bearing portions of the frame through said first, second and third feed oil passages by virtue of the pressure difference existing between said discharge pressure in said oil reservoir and the intermediate pressure in said back pressure chamber.

2. A scroll fluid machine as defined in claim 1, wherein said first feed oil passage comprises a first feed oil bore opening to said oil reservoir, and a second feed oil bore communicating with said first feed oil bore and extending to said sliding surface, and wherein said second feed oil passage comprises a third feed oil bore opening to said sliding section and always communicating with said second feed oil bore and a fourth feed oil bore communicating with said third feed oil bore and extending to a central portion of said orbiting scroll, said fourth feed oil bore opening in confronting relation to an end face of said drive shaft.

3. A scroll fluid machine as defined in claim 2, wherein said second feed oil bore is formed into a dish shape having a radius at least equal in dimension to a sum of an orbiting radius of said orbiting scroll and a radius of said third feed oil bore.

4. A scroll fluid machine as defined in claim 1, wherein a seal member is arranged about the other end of said first feed oil passage which opens to said sliding surface.

* * * * *